US010422337B2

(12) United States Patent
Daugaard et al.

(10) Patent No.: US 10,422,337 B2
(45) Date of Patent: Sep. 24, 2019

(54) SELF-PRIMING CENTRIFUGAL PUMP

(71) Applicant: ALFA LAVAL CORPORATE AB, Lund (SE)

(72) Inventors: Poul Anton Daugaard, Kolding (DK); Jesper Raabjerg Jensen, Middelfart (DK); Kenneth Rehhoff, Odense C (DK)

(73) Assignee: ALFA LAVAL CORPORATE AB, Lund (SE)

( * ) Notice: Subject to any disclaimer, the term of this patent is extended or adjusted under 35 U.S.C. 154(b) by 423 days.

(21) Appl. No.: 15/110,271

(22) PCT Filed: Dec. 12, 2014

(86) PCT No.: PCT/EP2014/077506
§ 371 (c)(1),
(2) Date: Jul. 7, 2016

(87) PCT Pub. No.: WO2015/104137
PCT Pub. Date: Jul. 16, 2015

(65) Prior Publication Data

US 2016/0333882 A1 Nov. 17, 2016

(30) Foreign Application Priority Data

Jan. 12, 2014 (EP) ..... 14150862

(51) Int. Cl.
*F04D 9/02* (2006.01)
*F04D 31/00* (2006.01)
(Continued)

(52) U.S. Cl.
CPC ..... *F04D 9/02* (2013.01); *F04D 3/02* (2013.01); *F04D 31/00* (2013.01)

(58) Field of Classification Search
CPC . F04D 9/00; F04D 9/001; F04D 9/002; F04D 9/02; F04D 9/004; F04D 9/04; F04D 31/00
See application file for complete search history.

(56) References Cited

U.S. PATENT DOCUMENTS 2,704,516 A 3/1955 Mock et al.
4,142,839 A 3/1979 Davis et al.
(Continued)

FOREIGN PATENT DOCUMENTS

CA 2435063 A1 5/2003
CN 2325561 Y 6/1999
(Continued)

OTHER PUBLICATIONS

International Search Report (PCT/ISA/210) dated Mar. 11, 2015, by the European Patent Office as the International Searching Authority for International Application No. PCT/EP2014/077506.
(Continued)

*Primary Examiner* — Richard A Edgar
(74) *Attorney, Agent, or Firm* — Buchanan Ingersoll & Rooney PC

(57) ABSTRACT

A self-priming, centrifugal pump comprising a first housing part having a front wall with an inlet, a second housing part having an outlet, an impeller rotatably arranged in the second housing part and a pump screw rotatably arranged in the first housing part, connected to the impeller and comprising a center body around which a helical blade is arranged for feeding the impeller with any gas that is present in the liquid, wherein the center body is arranged at a distance from a side of the front wall that faces the center body, such that a channel with a width of at least 12 mm is formed between the center body and the side of the front wall that faces the center body.

20 Claims, 6 Drawing Sheets

(51) Int. Cl.

| | |
|---|---|
| ***F04D 3/02*** | (2006.01) |
| *F04D 29/22* | (2006.01) |
| *F04D 29/42* | (2006.01) |

(56) References Cited

U.S. PATENT DOCUMENTS

| | | | | |
|---|---|---|---|---|
| 4,770,604 | A | 9/1988 | Luthi et al. | |
| 5,100,295 | A | 3/1992 | Madden | |
| 5,368,438 | A | 11/1994 | Raible | |
| 5,575,615 | A | 11/1996 | Mohn | |
| 6,343,909 | B1 | 2/2002 | Springer et al. | |
| 6,585,493 | B2 * | 7/2003 | Sutton | F04D 9/041 417/199.2 |
| 6,923,694 | B2 | 8/2005 | Ishigaki | |
| 7,201,565 | B2 | 4/2007 | Ku et al. | |
| 8,210,808 | B2 | 7/2012 | Clarence et al. | |
| 8,511,966 | B2 | 8/2013 | Stahle | |
| 8,944,767 | B2 | 2/2015 | Stoicescu et al. | |
| 9,546,625 | B2 | 1/2017 | Stoicescu et al. | |
| 9,562,502 | B2 | 2/2017 | Stoicescu et al. | |
| 2002/0034446 | A1 | 3/2002 | Sutton | |
| 2002/0098090 | A1 | 7/2002 | Muhs | |
| 2004/0067133 | A1 | 4/2004 | Ishigaki et al. | |
| 2013/0183155 | A1 | 7/2013 | Stoicescu et al. | |
| 2013/0320148 | A1 | 12/2013 | Lewis | |
| 2016/0097399 | A1 | 4/2016 | Stoicescu et al. | |
| 2016/0327046 | A1 | 11/2016 | Daugaard et al. | |
| 2018/0291919 | A1 | 10/2018 | Stoicescu et al. | |

FOREIGN PATENT DOCUMENTS

| | | | | | |
|---|---|---|---|---|---|
| CN | 1335916 | A | | 2/2002 | |
| CN | 1926338 | A | | 3/2007 | |
| CN | 101861209 | A | | 10/2010 | |
| CN | 103122860 | A | | 5/2013 | |
| CN | 103124852 | A | | 5/2013 | |
| CN | 203130596 | U | | 8/2013 | |
| DE | 10 2007 032 228 | A1 | | 1/2009 | |
| DE | 10 2011 106 525 | A1 | | 1/2013 | |
| DE | 102011106525 | A1 | | 1/2013 | |
| EP | 1 191 228 | A2 | | 3/2002 | |
| EP | 2 672 120 | A2 | | 12/2013 | |
| EP | 2672120 | A2 | | 12/2013 | |
| FR | 2667654 | A1 | | 4/1992 | |
| GB | 1523893 | A | * | 9/1978 | B01F 7/063 |
| JP | 2010014077 | A | * | 1/2010 | F04D 29/44 |
| SU | 964 245 | A1 | | 10/1982 | |
| SU | 964245 | A1 | | 10/1982 | |
| WO | WO 2006/061914 | A1 | | 6/2006 | |
| WO | WO 2009/007075 | A2 | | 1/2009 | |

OTHER PUBLICATIONS

Written Opinion (PCT/ISA/237) dated Mar. 11, 2015, by the European Patent Office as the International Searching Authority for International Application No. PCT/EP2014/077506.

"GEA Flow Components Business Line, Hygienische Pumpen, Katalog 2012, engineering for a better world, GEA Mechanical Equipment", Jan. 1, 2012, pp. 1-128, XP055118620.

Grundfos Hygienic Self Priming, "Optimise Your Cleaning Process with Improved Technology", Oct. 2, 2013. publication date unknown, but publicly available at least as early as Oct. 2, 2013, 3 pages.

"Curved Pipes", publication date unknown, but publicly available at least as early as Oct. 14, 2013, 1 page.

Chinese Official Action dated Apr. 28, 2017 issued by the Chinese Patent Office in corresponding Chinese Patent Application No. 2014800729024 (10 pages).

Chinese Official Action dated Jun. 16, 2017 issued by the Chinese Patent Office in Chinese Patent Application No. 201480072887.3 corresponding to U.S. Appl. No. 15/110,225 (8 pages).

"GEA Tuchenhagen®—Variflow Hygienic Centrifugal Pumps TP/TPS Series", Catalogue 2012, engineering for a better world, GEA Mechanical Equipment, 2012 (128 pages).

Feature Listing claim 1, Jul. 4, 2018, cited in Opposition papers filed in counterpert European Application No. 2 893 343 (2 pages).

Stephan Dirks, "Hygienic PumpTechnology", GEA Tuchenhagen, Nov. 18, 2015 (12 pages) (identified as Document E2 in Opposition papers).

"Pump", a3Ds Automated 3D Scanning, Dec. 16, 2015 (4 pages) (identified as Document E3 in Opposition papers).

Tony Keville, E-Mail from Tony Keville to Lutz Koenig, Subject: Re: Inquiry for Pumps, Oct. 2, 2015 (1 page) (identified as Document E4 in Opposition papers).

Tomlinson Hall Website Screenshots, Jul. 4, 2018 (2 pages) (identified as Document E5 in Opposition papers).

"Liquid ring vacuum pumps show their cost advantage", World Pumps Mar. 2013 (2 pages). (identified as Document E16 in Opposition papers).

Legros Sas, "Liquivac the Hybrid Pump", Jul. 4, 2018 (12 pages). (identified as Document E7 in Opposition papers).

Google Screenshot—liquivac lvk20, Jul. 4, 2018 (1 page). (identified as Document E8 in Opposition papers).

Liquivac Installation, Operation & Maintenance Manual, Jul. 4, 2018 (24 pages) (identified as Document E9 in Opposition papers).

Unbenannt Pump, a3Ds Automated 3D Scanning, Dec. 16, 2015 (1 page). (identified as Document E10 in Opposition papers).

Opposition filed on Jul. 4, 2018 in counterpart European Application No. 2 893 343, and English language translation of Sections II, III, IV, V and VI of Opposition.

* cited by examiner

SELF-PRIMING CENTRIFUGAL PUMP

TECHNICAL FIELD

The invention relates to self-priming centrifugal pumps that have one housing part for an impeller that pumps liquid and another housing part for a pump screw that feeds the impeller with liquid and any gas that is present in the liquid.

BACKGROUND ART

Today so called centrifugal pumps are used to transport liquids by the conversion of rotational kinetic energy to the hydrodynamic energy of the liquid flow. The rotational energy is typically generated by a motor. The pump has a housing, or casing, and an impeller is arranged inside the housing. The fluid enters the impeller along or near to a rotating axis of the impeller and is accelerated by the impeller, flowing radially outward towards an outlet of the housing, from where it exits.

Most centrifugal pumps are not self-priming. Then the pump housing must be filled with liquid before the pump is started, otherwise the pump will not be able to function. If the pump housing becomes filled with gases or vapors, the impeller becomes gas-bound and incapable of pumping the liquid. To ensure that a centrifugal pump remains primed (filled with liquid) and does not become gas-bound, most centrifugal pumps are located below the level of the source from which the pump is to draw the liquid. The same effect can be obtained by supplying liquid to the pump suction side of the pump. This liquid is then supplied under pressure, for example by another pump or by implementing the pump as a so called self-priming, centrifugal pump that recirculates a part of the liquid vie a liquid return conduit.

Self-priming, centrifugal pumps have been described in a number of documents, such as in U.S. Pat. No. 6,585,493 where a self-priming, centrifugal pump has a pump housing with an inlet opening and an outlet piece. An impeller wheel rotates inside the pump housing. The inlet opening is connected with a liquid ring pump section that has an auxiliary housing with an internal pump screw. The pump screw rotates together with the impeller wheel and a recycling (recirculation) pipe for pumped liquid connects the outlet piece with the auxiliary housing. The pump is self-primed by virtue of the recycling pipe that returns a part of the pumped liquid to or near the inlet of the pump during pumping, which means that it is primed during operation even if some gas should be present in the pumped liquid.

The pump screw in the auxiliary housing has a helical blade and is coaxially arranged with the impeller. The auxiliary housing is symmetrical and is arranged with its center axis in parallel and offset to a rotational axis of the pump screw, which enables the pump screw to transport to the impeller any gas that might be present in the liquid.

WO 2009/007075 discloses another self-priming, centrifugal pump that is similar to the one previously described but for a different connection of the recycling pipe, which is connected from the impeller housing to the housing that holds the pump screw.

The prior art is successfully employed as self-priming, centrifugal pumps and are able to pump liquids where some gas or vapor is present. The pump efficiency, i.e. the ratio of the power imparted on the fluid by the pump in relation to the power supplied to drive the pump, is often reasonably good but it is estimated that it may still be improved.

SUMMARY

It is an object of the invention to improve the above-identified prior art. In particular, it is an object to increase pump efficiency for a self-priming, centrifugal pumps that uses a pump screw for feeding to the pump's impeller gas that might be present in a pumped liquid.

To solve these objects a self-priming, centrifugal pump is provided. The centrifugal pump comprises a first housing part that has a front wall with an inlet for receiving liquid, a second housing part that has an outlet for expelling the liquid. The first housing part is connected to the second housing part for enabling the liquid to flow from the first housing part and into the second housing part. An impeller is rotatably arranged in the second housing part about a central axis for pumping the liquid from the inlet to the outlet when the impeller is rotated, and a pump screw is rotatably arranged in the first housing part about the central axis, connected to the impeller and comprises a center body around which a helical blade is arranged for feeding the impeller with any gas that is present in the liquid. The center body is arranged at a distance from a side of the front wall that faces the center body, such that a channel with a width of at least 12 mm is formed between the center body and the side of the front wall that faces the center body.

The centrifugal pump is advantageous in that it has, compared with the available prior art, a significantly higher pump efficiency. The higher efficiently is due to the width of the channel between the center body and the side of the front wall that faces the center body.

The channel may have a width of at least 16 mm or at least 20 mm. Increasing the width of the channel for the centrifugal pump to 16 mm respectively 20 mm has shown to increase the pump efficiency even more.

The channel may extend from the side of the front wall that faces the center body, to i) an edge portion of the center body, the edge portion defining an axial end section of the center body, or to ii) a tapering section of the center body, the tapering section defining a section of the center body where a diameter of the center body starts to decrease in a direction towards the inlet. The two embodiments i) and ii) both provide increased pump efficiency.

The channel with a width of at least 12 mm, at least 16 mm or at least 20 mm may be measured in a direction that is parallel to an axial direction of the central axis.

The center body may be arranged at a distance from a side of an intermediate wall that faces the center body and that is located between the first housing part and the second housing part, such that a channel with a width of at least 12 mm is formed between the center body and the side of the intermediate wall that faces the center body. Such a channel between the center body and the intermediate wall provides increased pump efficiency.

The helical blade may comprise a front edge that faces the inlet and a back edge that faces the second housing part, the front edge of the helical blade being located at a distance of least 12 mm from the side of the front wall that faces the helical blade.

The helical blade may comprise an end blade that extends in a direction towards the front wall that faces the helical blade. The front edge is thus located between the helical blade and the front wall that faces the helical blade. The front edge increases pump efficiency and assists in feeding the impeller with gas that might be present in the liquid.

The helical blade may have a first lead angle and the end blade may have a second lead angle, the second lead angle being greater than the first lead angle and smaller than 90°. The helical blade and the end blade may have same lead angles, such that the end blade is an extension of the helical blade, but having different lead angles improves the gas feeding capability of the pump screw.

The second lead angle may be at least 5° greater than the first lead angle and smaller than 80°.

The second lead angle may be a mean lead angle of the end blade. This means that the end blade may be both curved and straight. When the end blade is curved the men lead angle is determined as the angle the end blade has between its ends.

The end blade may have a length of at least 10 mm, as measured in a direction parallel to the central axis. This improves the pump efficiency.

The center body may comprise a front edge that faces the inlet and from which an amount of material that corresponds to at least a radius of 4 mm is removed, such that the front edge forms a curved front edge. Such front edge provides increased pump efficiency.

The center body may comprise a back edge that faces the second housing part and from which an amount of material that corresponds to at least a radius of 4 mm is removed, such that the back edge forms a curved back edge. A back edge like this increases pump efficiency.

The centrifugal pump may comprise a return conduit that is connected from a side of the second housing part that faces the first housing part, to a side of the first housing part where the inlet is arranged, for allowing a part of the fluid to be returned from the second housing part to the first housing part when the impeller is rotated. This particular connection increases pump efficiency.

Experiments have shown that all features above provide, to a greater or smaller extent, increased pump efficiency. Features above may be individually implemented but a combination of features will give a better pump efficiency.

Still other objectives, features, aspects and advantages of the invention will appear from the following detailed description as well as from the drawings.

BRIEF DESCRIPTION OF THE DRAWINGS

Embodiments of the invention will now be described, by way of example, with reference to the accompanying schematic drawings, in which.

DETAILED DESCRIPTION

Figure 1:
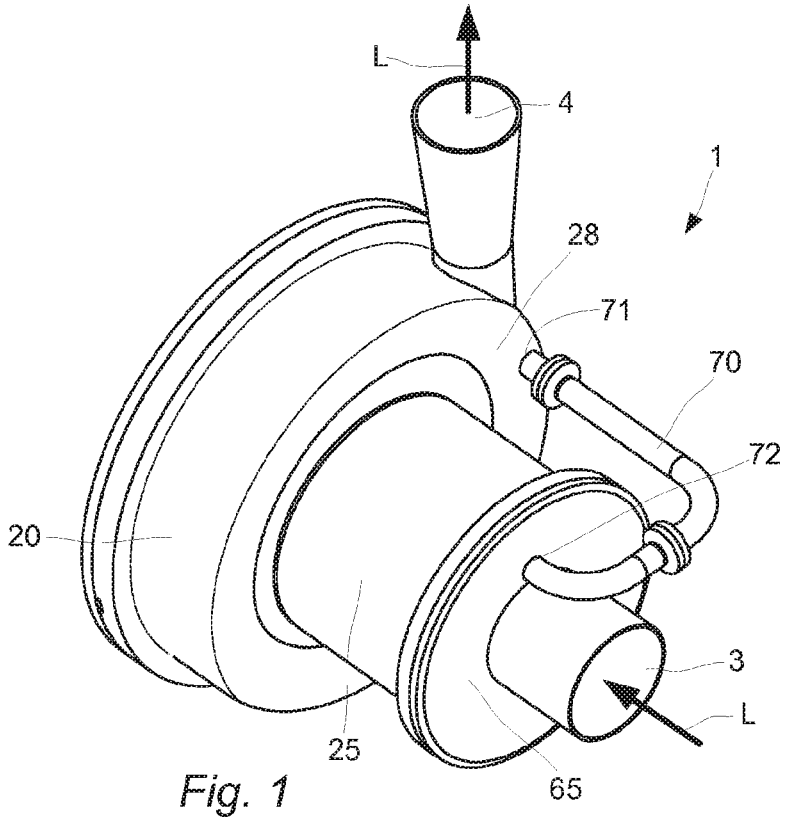
FIG. 1 is a perspective view of a self-priming, centrifugal pump.

With reference to FIG. 1 a self-priming, centrifugal pump 1 is illustrated, which hereafter is referred to as pump 1. The pump 1 has a first housing part 25 and a second housing part 20. The first housing part 25 has an inlet 3 that is connectable to e.g. a pipe (not shown) for receiving a liquid L. The two housing parts 25, 20 are connected to each other such that the liquid L that enters the first housing part 25 via the inlet 3 flows from the first housing part 25 and into the second housing part 20. The liquid L exits from the second housing part 20 via an outlet 4 that is connectable to e.g. a pipe (not shown).

Figure 2:
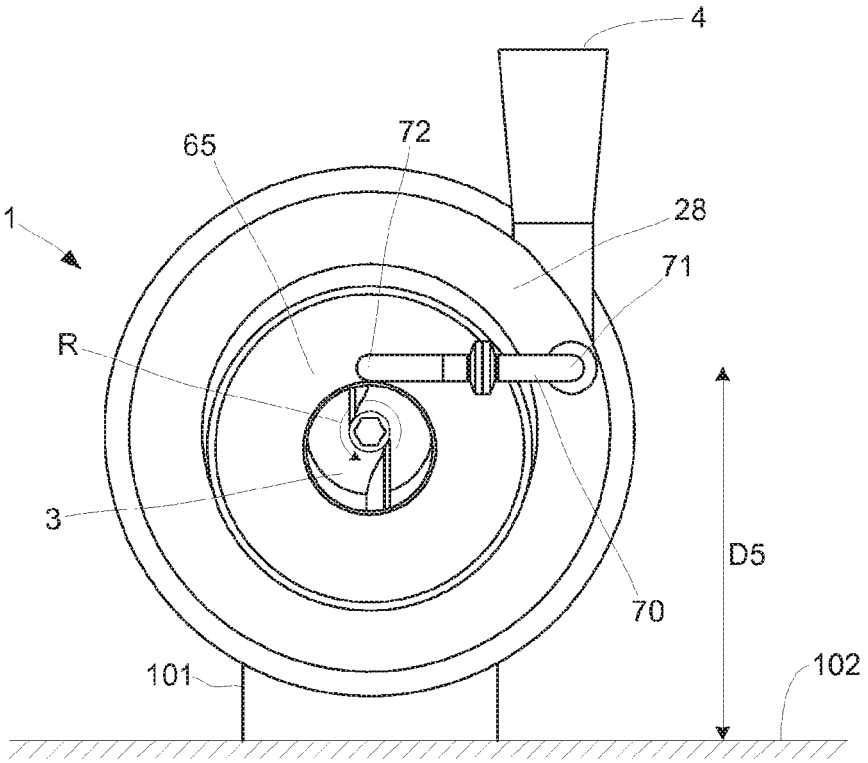
FIG. 2 is a front view of the pump of FIG. 1, seen slightly from above.

With further reference to FIG. 2, a return conduit 70 is connected from a side 28 of the second housing part 20 that faces the first housing part 25, to a side 65 of the first housing part 25 where the inlet 3 is arranged. The side 28 of the second housing part 20 where the return conduit 70 is connected is referred to as a front side 28 of the second housing part 20 and the side 65 of the first housing part 25 where the return conduit 70 is connected is referred to as a front side 65 of the first housing part 25. The return conduit 70 has thus an inlet connection 71 that is connected to the front side 28 of the second housing part 20 and an outlet connection 72 that is connected to the front side 65 of the first housing part 25. This allows some of the liquid to recirculate in the pump 1, from the second housing part 20 and into the first housing part 25, which makes the pump "prime" itself in case there is some gas in the liquid when the pump pumps the liquid, i.e. the pump 1 is a self-priming pump. Both the inlet connection 71 and the outlet connection 72 of the return conduit 70 are arranged at the same height D5 over a surface 102 on which the pump 1 is installed when it is ready to operate. A conventional pump support 101 is used for attaching the pump 1 to the surface 102.

Figure 3:
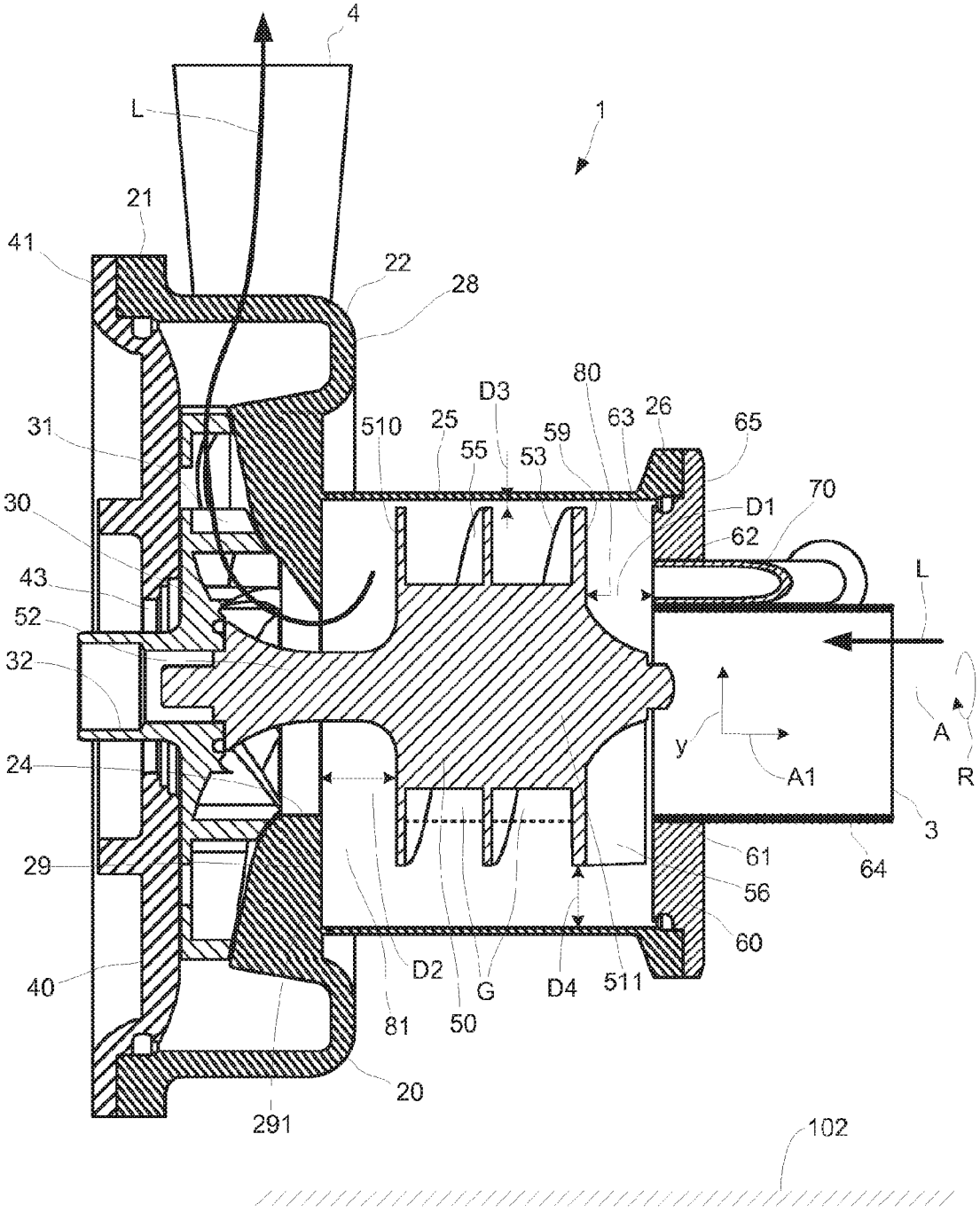
FIG. 3 is a cross-sectional side view of the pump of FIG. 1.
Figure 4:
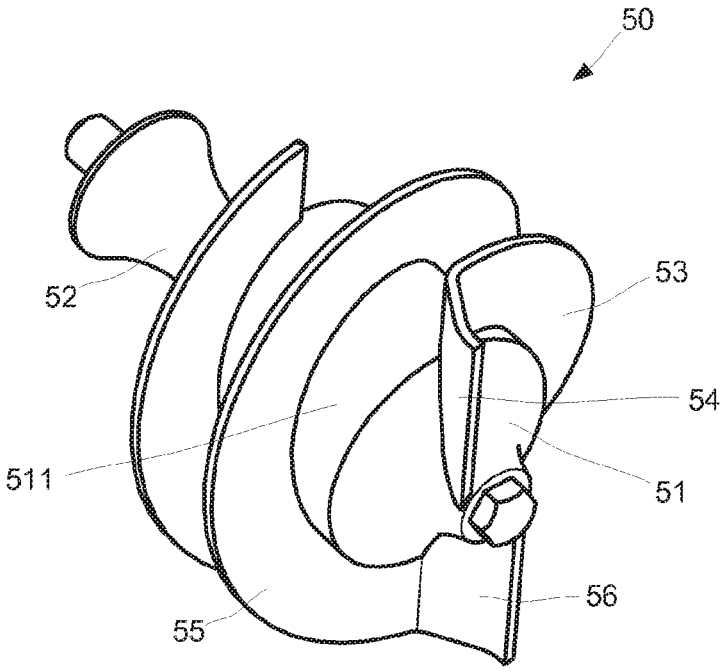
FIG. 4 is a perspective view of a first embodiment of a pump screw that may be used for the pump of FIG. 1.
Figure 5:
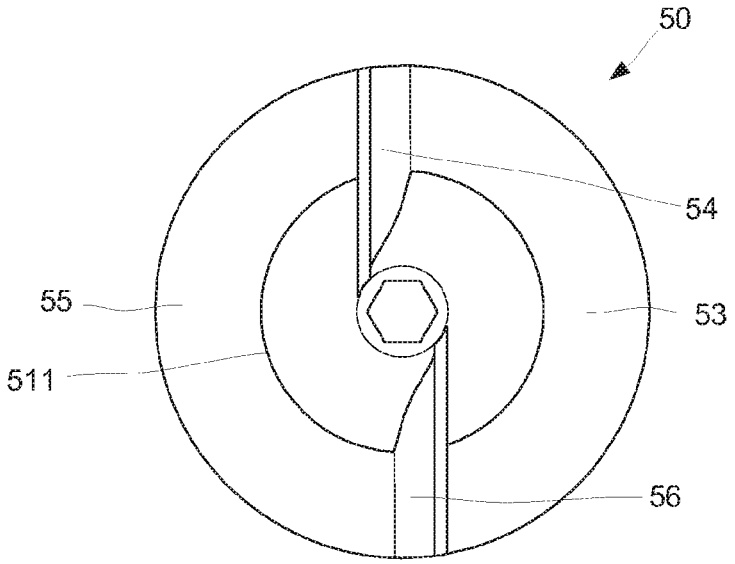
FIG. 5 is a front view of the pump screw of FIG. 4.
Figure 6:
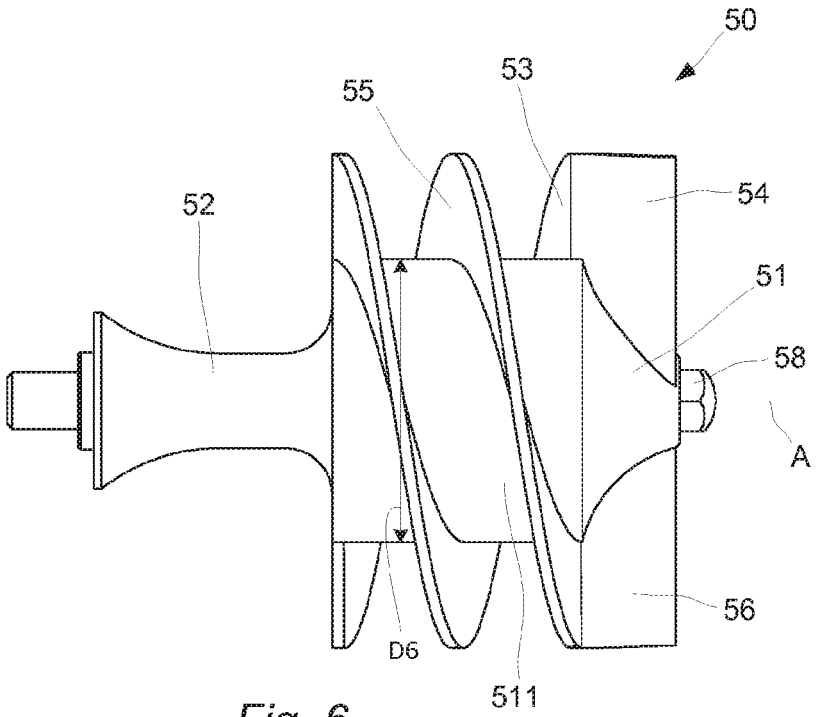
FIG. 6 is a side view of the pump screw of FIG. 4.

With further reference to FIG. 3 the first housing part 25 has substantially a cylindrical shape with an edge 26 to which a front wall 60 is attached. The front wall 60 comprises the front side 65 of the first housing part 25. The front wall 60 has the shape of a circular plate with a circular hole 61. The inlet 3 has the form of a tube 64 that is attached to the circular hole 61. The front wall 60 has an opening 62 that is located vertically above the circular hole 61. The outlet connection 72 of the return conduit 70 is connected to the opening 62. The front wall 60 may be referred to as an inlet side of the first housing part 25.

An end of the first housing part 25 that is opposite the edge 26 is attached to the second housing part 20. The second housing part 20 is symmetrical and comprises a front part 22 that together with a back plate 40 form an enclosed space in which an impeller 30 is arranged. The back plate 40 is at a peripheral section 41 attached to a peripheral edge 21 of the second housing part 20. The second housing part 20 is symmetrical about a central axis A and the impeller 30 is arranged to rotate about the central axis A. A center section 32 of the impeller 30 protrudes out from the second housing part 20, through an opening 43 in the back plate 40. The center section 32 of the impeller 30 is in turn attached to a drive axis of a conventional motor unit (not shown), which allows the impeller 30 to rotate when the motor unit is activated. The rotational direction R of the impeller 30 is illustrated in FIGS. 2 and 3. When the impeller 30 is rotated vanes 31 on the impeller 30 accelerates the fluid F in a direction radially outwards, i.e. towards the outlet 4 which thereby effects pumping of the liquid L from the inlet 3 to the outlet 4.

A pump screw 50 is rotatably arranged in the first housing part 25 about the central axis A. The pump screw 50 comprises a center body 511 and an axial section 52 that extends from the center body 511. The pump screw 50 is symmetrical about the central axis A and the axial section 52 is fixedly connected to the impeller 30 at a center of the impeller 30. Thus, when the impeller 30 rotates, the pump screw 50 rotates coaxially together with the impeller 30.

A helical blade 53 is arranged around the center body 511 for feeding to the impeller 30 any gas that might be present in the liquid L. The helical blade 53 is a first helical blade 53 of two helical blades that are arranged on the center body 511, i.e. a second helical blade 55 is also arranged around the center body 511 for feeding any gas that might be present in the liquid L. Each of the helical blades 53, 55 makes one complete helix turn around the center body 511. Preferably, the center body 511 comprises at least one helical blade that makes at least one complete helix turn around the center body 511, such as the first helical blade 53.

As mentioned, the second housing part 20, the impeller 30 and the pump screw 50 are symmetrically arranged around the central axis A. However, the first housing part 25 is, even though it has a symmetrical shape, offset from the central axis A by a predetermined distance. Specifically, the first housing part 25 is, as seen along a vertical direction y when the pump 1 is installed and ready for operation, offset in a downward direction, i.e. in a direction towards the ground (or offset in a direction towards the surface 102 over which the pump 1 is installed). By virtue of this offset arrangement, the first helical blade 53 and the second helical blade 55 are arranged, as seen in the vertical direction y of the pump 1, at a distance D3 from an upper section of an interior wall of the first housing part 25 and at a distance D4 from a upper section of an interior wall of the first housing part 25, where the distance D3 from the upper section is smaller than the distance D4 from the lower section. This enables, when gas is present in the liquid L and when the pump screw 50 rotates, the gas to be trapped in gas pockets G between the helical blades 53, 55. The circular hole 61 and the inlet 3 are part of the first housing part 25 and are thus also offset from the central axis A.

When the pump screw 50 rotates the gas pockets G are created by the rotations which causes liquid L in the first housing part 25 to rotate about the central axis A and, by virtue of the centrifugal effect, causes the liquid L to be pressed outwards in a radial direction towards interior, radial walls the first housing part 25. Since the gas has a lower density than the liquid and since the first housing part 25 is offset from the axis of rotation (the central axis A) of the pump screw 50, the gas is trapped as near the central axis A as it can get, in gas pockets G at the lower part of the center body 511.

The center body 511 of the pump screw 50 is arranged at a distance D1 of at least 12 mm from a side 63 of the front wall 60 that faces the center body 511. This distance provides a channel 80 with a width D1 of at least 12 mm between the center body 511 and the side 63 of the front wall 60 that faces the center body 511. In other embodiments the distance is larger, such that the channel 80 has a width D1 of at least 16 mm or a width of at least 20 mm. The side 63 of the front wall 60 may also be referred to as a surface 63 of the front wall 60, which surface 63 faces the center body 511.

The channel 80 with a width D1 of at least any of 12 mm, 16 mm or 20 mm is measured in a direction that is parallel to an axial direction A1 of the central axis A. The distance D1 between the center body 511 and the side 63 of the front wall 60 that faces the center body 511 may be at least any of 12 mm, 16 mm or 20 mm.

The center body 511 is arranged at a distance D2 of at least 12 mm from a side 291 of an intermediate wall 29 that faces the center body 511 and that is located between the first housing part 25 and the second housing part 20. This distance D2 provides a channel 81 with a width D2 of at least 12 mm between the center body 511 and the side 291 of the intermediate wall 29 that faces the center body 511. The intermediate wall 29 is typically a part of the front side 28 of the second housing part 20. The intermediate wall 29 has a passage 24 through which the axial section 52 of the pump screw 50 extends and through which the liquid L and any gas flow from the first housing part 25 and into the second housing part 20.

With further reference to FIGS. 4-7, the pump screw 50 comprises a tapered section 51 that extends from the center body 511, from a side of the center body 511 that is opposite the side of the center body 511 from which the axial section 52 extends. Thus, the tapered section 51 extends from the center body 511, in direction towards the side 63 of the front wall 60 that faces the pump screw 50. A base 519 of the tapered section 51 starts at the center body 511 such that the tapered section 51 is tapered in a direction towards the side 63. The tapered section 51 has at its top a nut 58 for allowing a tool to engage the pump screw 50 and to attach it to the impeller 30. Typically, the axial section 52 of the pump screw 50 has a threaded part that is screwed into the center section 32 of the impeller 30.

The tapered section 51 may be concavely tapered, as illustrated in the figures, convexly tapered or may have a linearly tapered form. In any case, the tapered section 51 has a diameter D7 or cross-section that, gradually and/or stepwise, decreases in a direction towards the inlet 3. The center body 511 has a diameter D6 and the base 519 of the tapered section 51 has the same diameter D6 as the center body 511.

The center body 511 has a front edge portion 512 and back edge portion 513. The front edge portion 512 faces the inlet 3 and the back edge portion 513 faces the second housing part 20. The tapered section 51 extends from the front edge portion 512. The front edge portion 512 is typically located at a distance of at least any of 12 mm, 16 mm and 20 mm from the side 63 of the front wall 60 that faces the center body 511. The back edge portion 513 is typically located at least 12 mm from the side 291 of the intermediate wall 29 that faces the center body 511.

Alternatively, the distance D1 is determined as the distance between the front wall 60 and the base 519 of the tapered section 51, where the tapered section 51 extends from the center body 511 in a direction towards the front wall 60. The front edge portion 512 of the center body 511 forms the perimeter of the base 519 of the tapering section 51. For the illustrated embodiment the channel 80 extends from the side 63 of the front wall 60 to the base 519 of the tapered section 51.

The first helical blade 53 has a front edge 59 that faces the inlet 3 and a back edge 510 that faces the second housing part 20. The front edge 59 of the helical blade 53 is typically located at a distance D1 of at least any of 12 mm, 16 mm or 20 mm from the side 63 of the front wall 60 that faces the center body 511.

The first helical blade 53 of the pump screw 50 has an end blade 54, which is referred to as a first end blade 54, that extends in a direction towards the front wall 60 that faces the helical blade 53. The first end blade 54 is typically attached to the front edge 59 and extends from the front edge 59 towards the front wall 60. The second helical blade 55 of the pump screw 50 has a corresponding end blade 56, which is referred to as a second end blade 56, that extends in a direction towards the front wall 60. The second end blade 56 may incorporate the same features as the first end blade 54.

The first helical blade 53 has a first lead angle $\alpha 1$ and the first end blade 54 has a second lead angle $\alpha 2$. The second lead angle $\alpha 2$ is greater than the first lead angle $\alpha 1$ and smaller than 90°. The second lead angle $\alpha 2$ may be at least 5° greater than the first lead angle α1 and smaller than 80°. The second helical blade 55 and the second end blade 56 may have the same lead angles as the first helical blade 53 respectively the first end blade 54. In this context, the lead angles may be expressed as common within the art, i.e. lead angle=arctan(I/π·dm), where I is lead of the helix of the helical blade respectively end blade, and dm is the mean diameter of the helix.

The first end blade 54 has a length of at least 10 mm, as measured in the direction A1 parallel to the central axis A. The first end blade 54 may have a length of any of at least 12 mm, at least 14 mm and at least 16 mm, as long as it is shorter than the distance by which the front edge 59 of the helical blade 53 is located from the side 63 of the front wall 60 that faces the center body 511.

Figure 7:
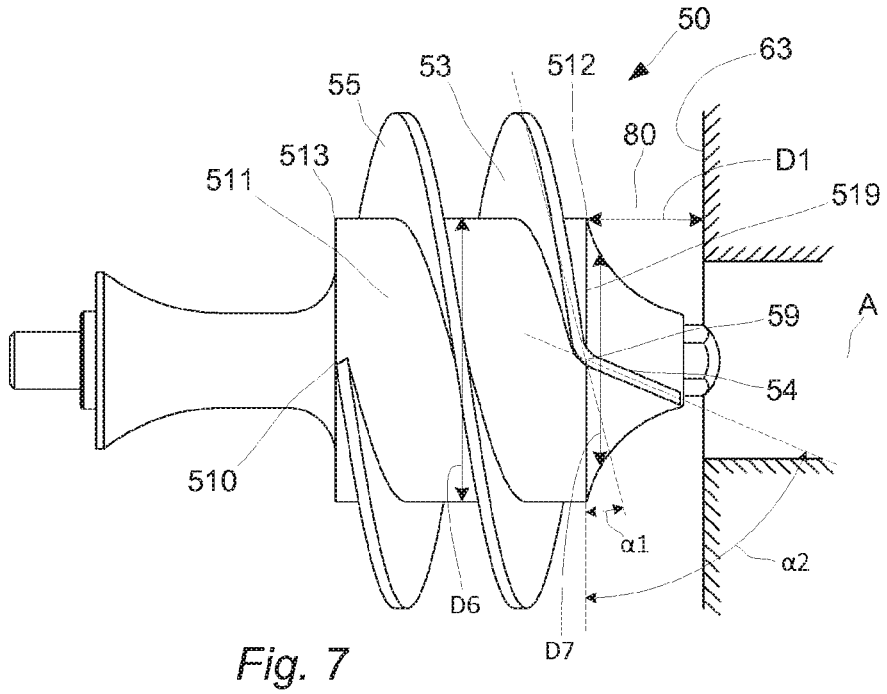
FIG. 7 is a side view of the pump screw of FIG. 4, rotated 90° and illustrated together with a section of a housing part front wall that faces the pump screw.
Figure 8:
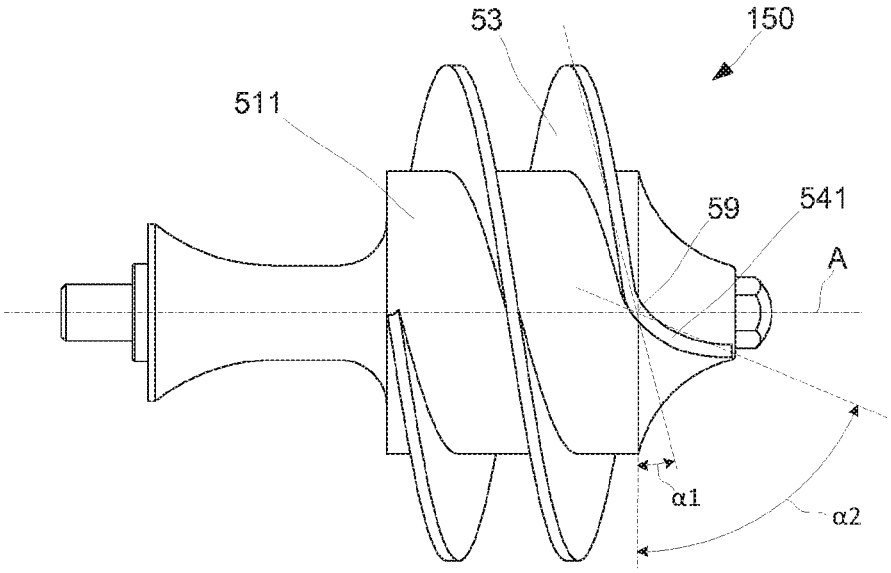
FIG. 8 is a side view of second embodiment of a pump screw.

As may be seen from FIG. 7, the first end blade 54 may be straight. With further reference to FIG. 8, another embodiment of a pump screw 150 for the pump 1 may have an end blade 541 that is curved. This curved end blade 541 has a lead angle α2 that is a mean lead angle of the end blade 541, as measured from the front edge 59 to the end of the end blade 541.

Figure 9:
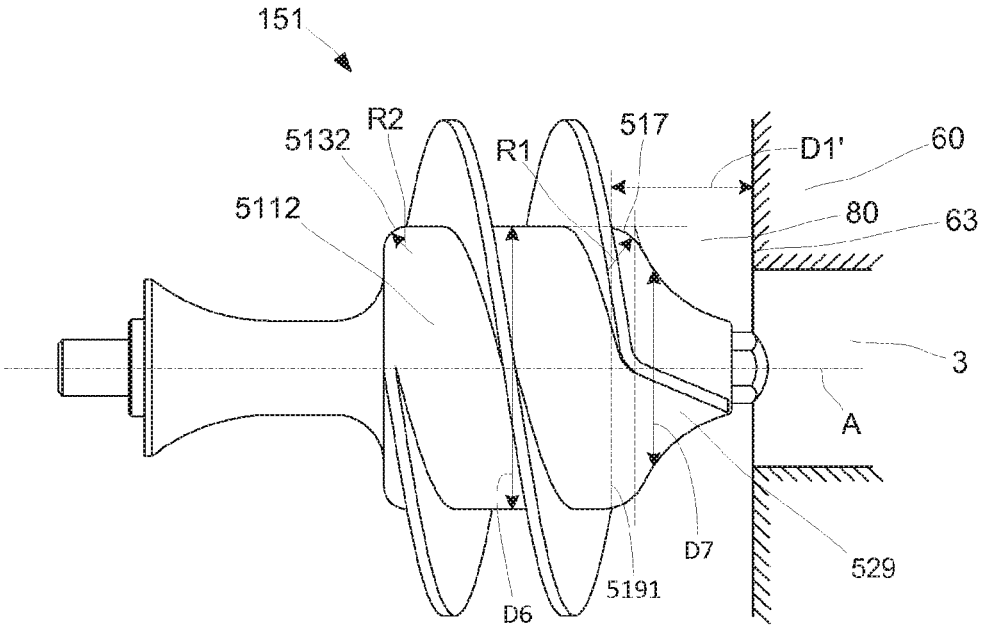
FIG. 9 is a side view of a third embodiment of a pump screw.

With reference to FIG. 9, another embodiment of a pump screw 151 for the pump 1 has a center body 5112 that comprises a front edge 517 that faces the inlet 3. From the front edge 517 an amount of material that corresponds to at least a radius R1 of 4 mm is removed, such that the front edge 517 forms a curved front edge. This does not necessarily mean that the curved front edge 517 must have a curvature in form of a circular arc. The front edge 517 may have another curvature, which typically is the case when more material than what corresponds to at least a radius R1 of 4 mm is removed from the front edge 517. The radius R1 may be at least 6 mm, at least 8 mm, at least 10 mm or at least 12 mm.

The center body 5112 has also a back edge 5132 that faces the second housing part 20 when the pump screw 151 is installed in the first housing part 25. An amount of material that corresponds to at least a radius R2 of 4 mm is removed from the back edge 5132, such that the back edge 5132 forms a curved back edge. As with the front edge 517, the back edge 5132 does not necessarily have a curvature in form of a circular arc. The back edge 5132 may have another curvature, for example when more material than what corresponds to at least a radius R2 of 4 mm is removed from the back edge 5132.

The center body 5112 of the pump screw 151 is arranged at a distance D1' of at least 12 mm from the side 63 of the front wall 60 that faces the center body 511. In this case the distance D1' may be determined as the distance between the front wall 60 and a section of the center body 5112 where the center body 5112 has its full diameter D6. Alternatively, the distance D1' is determined as the distance between the front wall 60 and a base 5191 of a tapered section 529, where the tapered section 529 extends from the center body 5112 and in a direction towards the front wall 60. The tapered section 529 has a diameter D7 or cross-section that, gradually and/or step-wise, decreases in a direction towards the inlet 3. Alternatively, the distance D1' is determined as the mean (average) distance between the front edge 517 and the front wall 60. The distance D1' may be at least 16 mm or at least 20 mm.

The distance D1' provides a channel 80 with a width D1' of at least 12 mm between the center body 5112 and the side 63 of the front wall 60 that faces the center body 511. As mentioned, the distance D1' may be larger, such that the channel 80 has a width D1' of at least 16 mm or a width of at least 20 mm.

Figure 10:
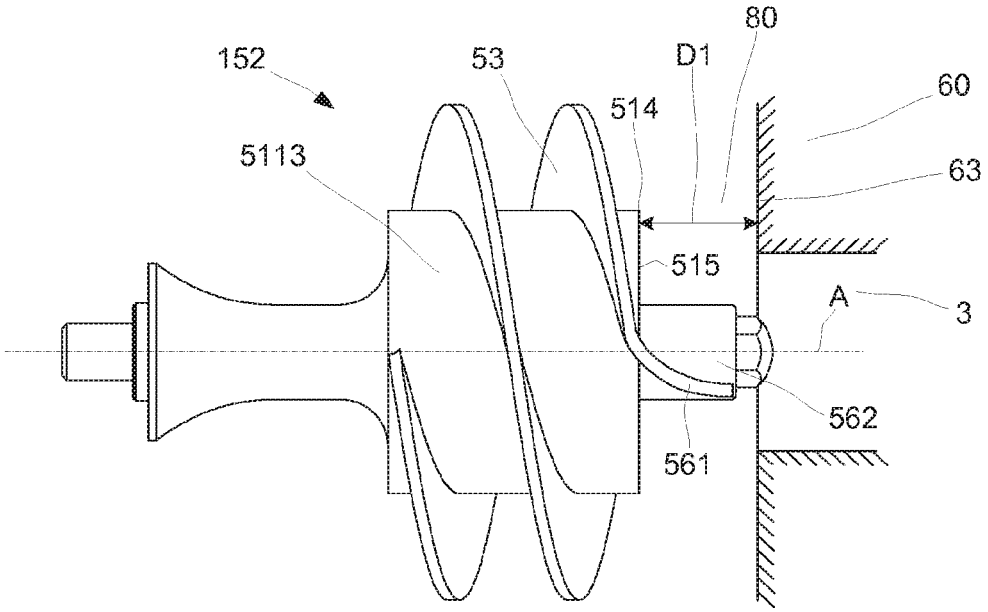
FIG. 10 is a side view of a fourth embodiment of a pump screw.

With reference to FIG. 10, another embodiment of a pump screw 152 for the pump 1 has a center body 5113 that comprises a front edge 514 that faces the inlet 3. The edge portion 514 defines an axial end surface 515 of the center body 5113, and the channel 80 extends from the side 63 of the front wall 60 that faces the center body 5113, to the edge portion 514 of the center body 5113. The distance D1 between the edge portion 514 and the side 63 is at least any of 12 mm, 16 mm and 20 mm. A channel 80 with the same width, i.e. at least any of 12 mm, 16 mm and 20 mm, is then formed between the center body 5113 and the side 63. The first helical blade 53 of the center body 5113 has an end blade 561 that extends over a cylindrical section 562 that extends from the center body 5113 towards the inlet 3.

For all embodiments of pump screws the channel 80 with a width D1 or D1' of at least any of 12 mm, 16 mm or 20 mm may be measured in a direction that is parallel to the axial direction A1 of the central axis A. The distance D1 or D1' between the respective center body and the side 63 of the front wall 60 that faces the center body is typically measured in the same direction, i.e. parallel to the axial direction A1 of the central axis A. The width of the channel 80 may be determined as the distance D1 or D1' between the respective center body and the side 63 of the front wall 60 that faces the center body.

From the description above follows that, although various embodiments of the invention have been described and shown, the invention is not restricted thereto, but may also be embodied in other ways within the scope of the subject-matter defined in the following claims.

The invention claimed is:

1. A self-priming, centrifugal pump comprising a first housing part having a front wall with an inlet for receiving liquid, a second housing part having an outlet for expelling the liquid, the first housing part being connected to the second housing part for enabling the liquid to flow from the first housing part and into the second housing part, an impeller rotatably arranged in the second housing part about a central axis for pumping the liquid from the inlet to the outlet when the impeller is rotated, a pump screw rotatably arranged in the first housing part about the central axis, connected to the impeller and comprising a center body around which a helical blade is arranged for feeding the impeller with any gas that is present in the liquid, wherein the center body is arranged at a distance from a side of the front wall that faces the center body, such that a channel with a width of at least 12 mm is formed between the center body and the side of the front wall that faces the center body, the at least 12 mm width of the channel resulting in the self-priming centrifugal pump having a higher pump efficiency compared to the best pump efficiency that would be produced by the self-priming centrifugal pump in which the width of the channel is less than 12 mm.

2. A centrifugal pump according to claim 1, wherein the channel has a width of at least 16 mm.

3. A centrifugal pump according to claim 1, wherein the channel has a width of at least 20 mm.

4. A centrifugal pump according to claim 1, wherein the channel extends from the side of the front wall that faces the center body, to an edge portion of the center body, the edge portion defining an axial end surface of the center body, or to a base of a tapered section that extends from the center body, the tapered section having a diameter that decreases in a direction towards the inlet.

5. A centrifugal pump according claim 1, wherein the channel with the width of at least 12 mm is measured in a direction that is parallel to an axial direction of the central axis.

6. A centrifugal pump according to claim 1, wherein the center body is arranged at a distance from a side of an intermediate wall that faces the center body and is located between the first housing part and the second housing part, such that a channel with a width of at least 12 mm is formed between the center body and the side of the intermediate wall that faces the center body.

7. A centrifugal pump according to claim 1, wherein the helical blade comprises a front edge that faces the inlet and a back edge that faces the second housing part, the front edge of the helical blade being located at a distance of least 12 mm from the side of the front wall that faces the helical blade.

8. A centrifugal pump according to claim 1, wherein the helical blade comprises an end blade that extends in a direction towards the front wall that faces the helical blade, and wherein the helical blade has a first lead angle ($\alpha$1) and the end blade has a second lead angle ($\alpha$2), the second lead angle ($\alpha$2) being greater than the first lead angle ($\alpha$1) and smaller than 90°.

9. A centrifugal pump according to claim 8, wherein the second lead angle ($\alpha$2) is at least 5° greater than the first lead angle ($\alpha$1) and smaller than 80°.

10. A centrifugal pump according to claim 8, wherein the second lead angle ($\alpha$2) is a mean lead angle of the end blade.

11. A centrifugal pump according to claim 8, wherein the end blade has a length of at least 10 mm, as measured in a direction parallel to the central axis.

12. A centrifugal pump according to claim 1, wherein the center body comprises a front edge that faces the inlet and from which an amount of material that corresponds to at least a radius of 4 mm is removed, such that the front edge forms a curved front edge.

13. A centrifugal pump according to claim 1, wherein the center body comprises a back edge that faces the second housing part and from which an amount of material that corresponds to a radius of at least 4 mm is removed, such that the back edge forms a curved back edge.

14. A centrifugal pump according to claim 1, comprising a return conduit that is connected from a side of the second housing part that faces the first housing part, to a side of the first housing part where the inlet is arranged, for allowing a part of the fluid to be returned from the second housing part to the first housing part when the impeller is rotated.

15. A self-priming, centrifugal pump comprising a first housing part having a front wall with an inlet for receiving liquid, a second housing part having an outlet for expelling the liquid, the first housing part being connected to the second housing part for enabling the liquid to flow from the first housing part and into the second housing part, an impeller rotatably arranged in the second housing part about a central axis for pumping the liquid from the inlet to the outlet when the impeller is rotated, a pump screw rotatably arranged in the first housing part about the central axis, connected to the impeller and comprising a center body around which a helical blade is arranged for feeding the impeller with any gas that is present in the liquid, the center body being arranged at a distance from a side of the front wall that faces the center body, such that a channel with a width of at least 12 mm is formed between the center body and the side of the front wall that faces the center body, and the helical blade comprises an end blade that extends in a direction towards the front wall that faces the helical blade.

16. A centrifugal pump according to claim 15, wherein the channel has a width of at least 16 mm.

17. A centrifugal pump according to claim 15, wherein the channel extends from the side of the front wall that faces the center body, to an edge portion of the center body, the edge portion defining an axial end surface of the center body, or to a base of a tapered section that extends from the center body, the tapered section having a diameter that decreases in a direction towards the inlet.

18. A centrifugal pump according claim 15, wherein the channel with the width of at least 12 mm is measured in a direction that is parallel to an axial direction of the central axis.

19. A centrifugal pump according to claim 15, wherein the center body is arranged at a distance from a side of an intermediate wall that faces the center body and is located between the first housing part and the second housing part, such that a channel with a width of at least 12 mm is formed between the center body and the side of the intermediate wall that faces the center body.

20. A centrifugal pump according to claim 15, wherein the helical blade has a first lead angle ($\alpha$1) and the end blade has a second lead angle ($\alpha$2), the second lead angle ($\alpha$2) being greater than the first lead angle ($\alpha$1) and smaller than 90°.

* * * * *